US008752821B2

(12) United States Patent
Toyooka et al.

(10) Patent No.: US 8,752,821 B2
(45) Date of Patent: Jun. 17, 2014

(54) IMAGE FORMING APPARATUS

(75) Inventors: Tsugunao Toyooka, Sagamihara (JP); Manabu Nonaka, Chigasaki (JP); Kazunori Bannai, Atsugi (JP)

(73) Assignee: Ricoh Company, Limited, Tokyo (JP)

( * ) Notice: Subject to any disclaimer, the term of this patent is extended or adjusted under 35 U.S.C. 154(b) by 451 days.

(21) Appl. No.: 12/923,035

(22) Filed: Aug. 30, 2010

(65) Prior Publication Data

US 2011/0052227 A1 Mar. 3, 2011

(30) Foreign Application Priority Data

Sep. 3, 2009 (JP) ..... 2009-203796

(51) Int. Cl.
*B65H 3/16* (2006.01)

(52) U.S. Cl.
USPC ..... 271/18.1; 271/18.2

(58) Field of Classification Search
USPC ..... 271/18.1, 193, 18.2
See application file for complete search history.

(56) References Cited

U.S. PATENT DOCUMENTS

| | | | | |
|---|---|---|---|---|
| 5,316,282 | A * | 5/1994 | Fukube et al. | 271/10.07 |
| 5,322,269 | A * | 6/1994 | Fukube et al. | 271/18.1 |
| 6,267,225 | B1 * | 7/2001 | Compera et al. | 198/691 |
| 7,334,858 | B2 * | 2/2008 | Kogure et al. | 347/16 |
| 8,020,851 | B2 * | 9/2011 | Higaki et al. | 271/18.1 |
| 2006/0033968 | A1 * | 2/2006 | Maki | 358/498 |
| 2007/0103532 | A1 * | 5/2007 | Imoto et al. | 347/104 |
| 2010/0032891 | A1 * | 2/2010 | Togashi et al. | 271/18.1 |
| 2010/0296851 | A1 * | 11/2010 | Toyooka et al. | 399/388 |

FOREIGN PATENT DOCUMENTS

| | | |
|---|---|---|
| JP | 05-139548 | 6/1993 |
| JP | 2003-237958 | 8/2003 |
| JP | 2004-262557 | 9/2004 |
| JP | 4204508 | 10/2008 |

OTHER PUBLICATIONS

Abstract of Japan Patent Publication number JP 2005-313348 published on Nov. 10, 2005.

* cited by examiner

*Primary Examiner* — Ernesto Suarez
(74) *Attorney, Agent, or Firm* — Harness, Dickey & Pierce, P.L.C.

(57) ABSTRACT

An image forming apparatus includes an image forming device to form an image on a sheet and a sheet feeding unit to feed the sheet to the image forming device. The sheet feeding unit includes an endless, dielectric belt disposed facing an upper surface of a sheet stack to contact and attract an uppermost sheet to the surface thereof and feed the sheet in the sheet feeding direction, and an electric potential pattern forming unit to form an electric potential pattern on the surface of the dielectric belt. The electric potential pattern has multiple potential holding sections of identical absolute values and opposite polarities disposed adjacent to each other at a uniform pitch. The electric potential pattern forming unit forms the electric potential pattern to have equal numbers of positive potential holding sections and negative potential holding sections.

18 Claims, 6 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2009-203796, filed on Sep. 3, 2009 in the Japan Patent Office, which is hereby incorporated by reference herein in its entirety.

BACKGROUND OF THE INVENTION

1. Field of the Invention

Exemplary embodiments of the present patent application relate to an image forming apparatus that incorporates a sheet feeding unit in which an uppermost sheet placed on top of a sheet stack is attracted to the surface of a dielectric belt by the action of an electric field generated by electric potential patterns formed on the surface of the dielectric belt and fed in a sheet feeding direction as the dielectric belt rotates.

2. Discussion of the Related Art

Related-art image forming apparatuses, such as copiers, facsimile machines, printers, or multifunction printers having at least one of copying, printing, scanning, and facsimile functions, typically form an image on a sheet of recording media according to image data. Thus, for example, a sheet feeding unit feeds a plurality of sheets one by one toward an image forming device. The image forming device forms an image on a sheet fed from the sheet feeding device.

The sheet feeding device incorporated in such related-art electrophotographic or inkjet image forming apparatuses often use a friction feed method by including a friction member to separate an uppermost sheet from other sheets of the sheet stack loaded in a sheet cassette. Specifically, the friction member, made of rubber having a high friction coefficient, pressingly contacts the uppermost sheet to separate the uppermost sheet from other sheets and conveys it as appropriate. One problem with such an arrangement is that the high friction coefficient of the friction member, which is necessary to feed the sheets to the image forming device in a stable manner, may deteriorate over time or according to environmental conditions, degrading feeding performance of the sheet feeding unit.

Further, when the image forming apparatus is used as a printer, it handles various types of recording media, such as plain paper, coated paper, and label paper. With recording media having a substantially small friction coefficient, sheets providing friction that varies depending on temperature, or sheets absorbing moisture and adhering to each other, the friction member of the sheet supplier may not separate the uppermost sheet from other sheets properly.

Further still, with recording media such as adhesive labels, the surface portion of the sheet can be easily separated from the underlying base layer of the sheet by the frictional force exerted between the pickup member and the recording medium, hindering reliable pick-up of the recording medium by the friction feeding method.

To address the above-described drawbacks, the image forming apparatus can employ an electrostatic sheet feed method in which recording media are electrically attracted to the surface of a dielectric belt by the action of an electric field generated by electric potential patterns formed on the surface of the dielectric belt and separated from a stack of recording media one by one as the dielectric belt rotates. As examples of an electrophotographic image forming apparatus that employs such an electrostatic sheet feed method, Japanese Patent Application Publication No. 05-139548 (JP-H05-139548-A) and Japanese Patent Application Publication No. 2003-237958 (JP-2003-237958-A1) have been proposed.

However, there is a drawback to the electrophotographic method. In the electrophotographic sheet feed method, if the uppermost sheet is picked up from the sheet stack immediately upon contact with the dielectric belt, several subsequent upper sheets can also be picked up together with the uppermost sheet by the dielectric belt. Therefore, to avoid this problem, the dielectric belt remains in contact with the sheet stack for a predetermined period of time from the moment the dielectric belt contacts the sheet stack before separating from the sheet stack. However, it is now known that subsequent sheets of the sheet stack can be still picked up together with the uppermost sheet even after the predetermined period of time has elapsed.

SUMMARY OF THE INVENTION

The present patent application provides a novel image forming apparatus that can separate an uppermost sheet from a sheet stack to feed the uppermost sheet in a sheet feeding direction without also simultaneously picking up succeeding sheets (multiple sheet feeding).

In one exemplary embodiment, an image forming apparatus includes an image forming device to form an image on a surface of a sheet, and a sheet feeding unit to feed the sheet to the image forming device. The sheet feeding unit includes an endless, dielectric belt and an electric potential pattern forming unit. The endless, dielectric belt is disposed facing an upper surface of a sheet stack including an uppermost sheet of multiple sheets to contact and attract the uppermost sheet to a surface thereof and feed the uppermost sheet in a sheet feeding direction as the dielectric belt rotates. The electric potential pattern forming unit forms an electric potential pattern on the surface of the dielectric belt. The electric potential pattern has multiple potential holding sections of identical absolute values and opposite polarities disposed adjacent to each other at a uniform pitch. The electric potential pattern forming unit forms the electric potential pattern to have equal numbers of positive potential holding sections and negative potential holding sections.

Each of the multiple potential holding sections may have a band-like shape extending in a direction perpendicular to the sheet feeding direction, with the multiple potential holding sections of opposite polarities arranged alternately in the sheet feeding direction.

The electric potential pattern forming unit may form the electric potential pattern to a length that is an integral multiple of the pitch of adjacent potential holding sections of different properties and equal to the length of a sheet of the sheet stack.

The above-described image forming apparatus may further include a pitch adjuster to change a pitch between the adjacent potential holding sections of opposite properties formed by the electric potential pattern forming unit.

The pitch adjuster may change the pitch between the adjacent potential holding sections of different properties according to one pitch option selected from among multiple predetermined pitch options. A length in the sheet feeding direction of a contact area of the surface of the dielectric belt which the upper surface of the sheet stack contacts may correspond to the least common multiple of all the pitches according to the multiple predetermined pitch options.

The above-described image forming apparatus may further include a sheet resistance detector to detect an electrical resistance of any sheet of the sheet stack. The pitch adjuster may change the pitch based on detection results obtained by the sheet resistance detector.

The above-described image forming apparatus may further include an ambient condition detector to detect at least one of temperature and humidity in the image forming apparatus. The pitch adjuster may changes the pitch based on detection results obtained by the ambient condition detector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
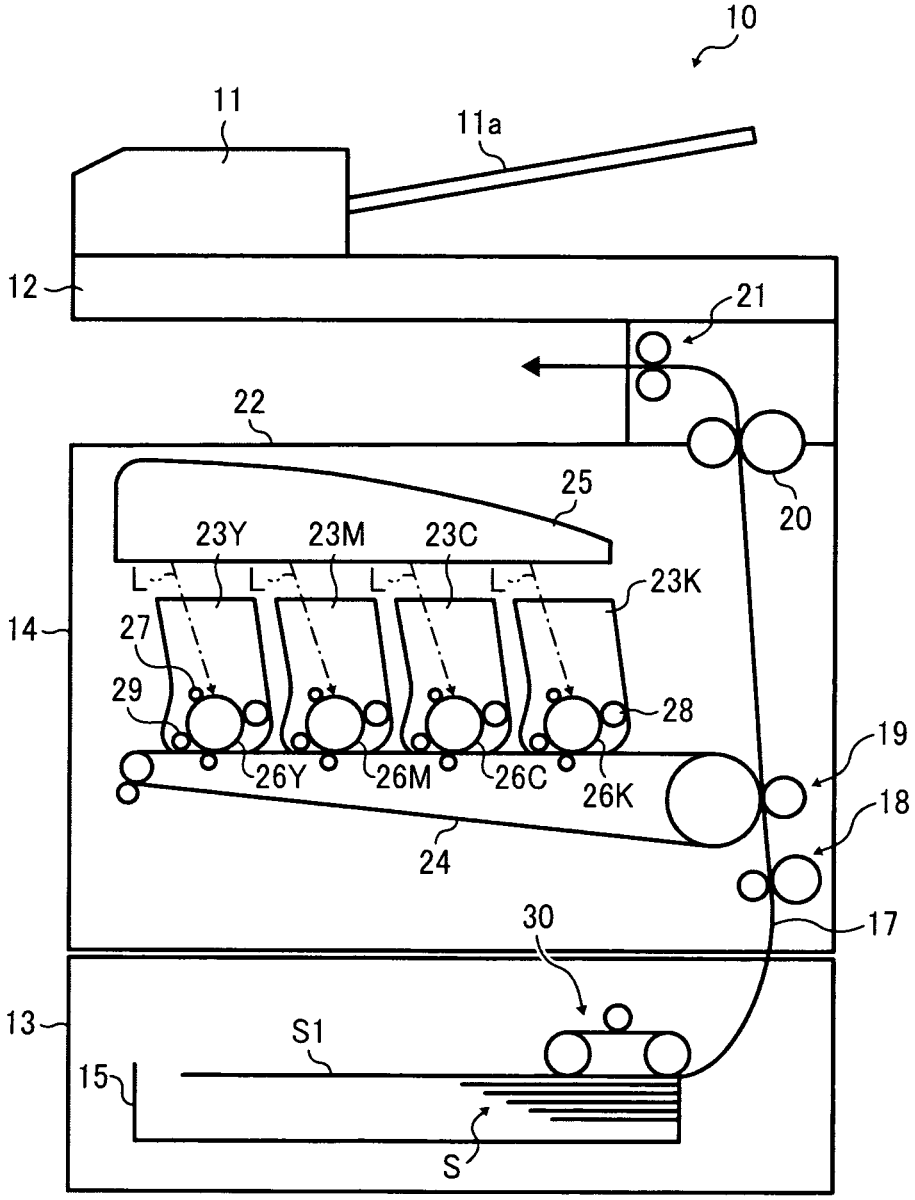
FIG. 1 is a schematic view of an image forming apparatus including a sheet feeding device, according to the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, region, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIG. 1 is a schematic view of the image forming apparatus 10 according to an exemplary embodiment of the present patent application.

In FIG. 1, the image forming apparatus 10 includes an automatic document feeder (hereinafter referred to as an "ADF") 11, a document reader 12, a sheet supplying device 13, an image forming device 14, a pair of registration rollers 18, a transfer roller 19, a fixing unit 20, a pair of sheet discharging rollers 21, and a sheet discharging tray 22.

As illustrated in FIG. 1, the image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this exemplary embodiment, the image forming apparatus 10 functions as a copier for forming an image on a recording medium by the electrophotographic method.

The ADF 11 is mounted on the document reader 12. The ADF 11 includes a document sheet tray 11*a* to hold a sheet stack thereon. The ADF 11 separates each sheet one by one from the sheet stack on the document sheet tray 11*a* to automatically feed the separated sheet to the document reader 12.

The document reader 12 reads image data of the sheet fed from the ADF 11 on a contact glass mounted thereon.

The sheet supplying device 13 that serves as a sheet feeding device is disposed below the image forming device 14. The sheet supplying device 13 accommodates a sheet stack S or recording media therein to supply an uppermost sheet $S_1$ that is picked up from the sheet stack, to the image forming device 14.

The image forming device 14 forms an image on the uppermost sheet $S_1$ supplied by the sheet supplying device 13 according to the image data read in the document reader 12.

According to this exemplary embodiment, the image forming device 14 can separate from the sheet supplying device 13 for supplying the uppermost sheet S to the image forming device 14.

The image forming device 14 includes four image forming units 23 (specifically, an image forming unit 23Y for forming yellow toner image, an image forming unit 23C for forming cyan toner image, an image forming unit 23M for forming magenta toner image, and an image forming unit 23K for forming black toner image), the intermediate transfer belt 24 that serves as an intermediate transfer member, and an optical writing device 25.

The optical writing device 25 receives color separation image data transmitted from an external device such as a personal computer or a word processor and image data of original documents read by the document reader 12 and converts the image data to a signal for light source driving. Accordingly, the optical writing device 25 drives a semiconductor laser in each laser light source unit and emits light beams L.

The image forming units 23Y, 23C, 23M, and 23K form respective single-color toner images different from each other. The image forming units 23Y, 23C, 23M, and 23K include a photoconductor 26 (specifically, a photoconductor 23Y for carrying yellow toner image thereon, a photoconductor 26C for carrying cyan toner image thereon, a photoconductor 26M for carrying magenta toner image thereon, and a photoconductor 26K for carrying black toner image thereon), and image forming components disposed around the photoconductor 26. The image forming components included in each of the image forming units 23Y, 23C, 23M, and 23K shown in FIG. 1 are a charging unit 27, a developing unit 28, and a cleaning unit 29.

The photoconductor 26 is a cylindrical image carrier that is rotated by a drive source, not illustrated, in a clockwise direction in FIG. 1. The photoconductor 26 has a photoconductive layer as an outer surface thereof.

The charging unit 27 is disposed contacting the photoconductor 26 to uniformly charge the outer surface of the photoconductor 26. The charging unit 27 according to this exemplary embodiment employs a contact-type charging method in which a charging member such as a charging roller uniformly charges the outer surface of the photoconductor 26 by contacting or nearly contacting the outer surface of the photoconductor 26. However, a charging method is not limited thereto.

The light beams L or light spots emitted by the optical writing device 25 irradiate the outer surface of the photoconductor 26 to optically write an electrostatic latent image according to image data.

The developing unit 28 supplies toner to the outer surface of the photoconductor 26 to develop the electrostatic latent image into a visible toner image. In this exemplary embodiment, a non-contact type developing unit that does not directly contact the photoconductor 26 is employed.

The cleaning unit 29 is a brush-contact-type unit in which a brush member thereof is disposed slidably contacting the outer surface of the photoconductor 26 to remove residual toner remaining on the outer surface of the photoconductor 26.

The intermediate transfer belt 24 is an endless belt member including a resin film or a rubber material. The toner image is transferred from the photoconductor 26 onto a surface of the intermediate transfer belt 24 before being further transferred onto the uppermost sheet $S_1$ at the secondary transfer nip formed by the transfer roller 19.

The uppermost sheet S1 having the toner image thereon is conveyed to the fixing unit 20 to be fixed to the uppermost sheet S1 by application of heat and pressure, and is finally discharged to the sheet discharging tray 22 by the pair of sheet discharging rollers 21.

Figure 2:
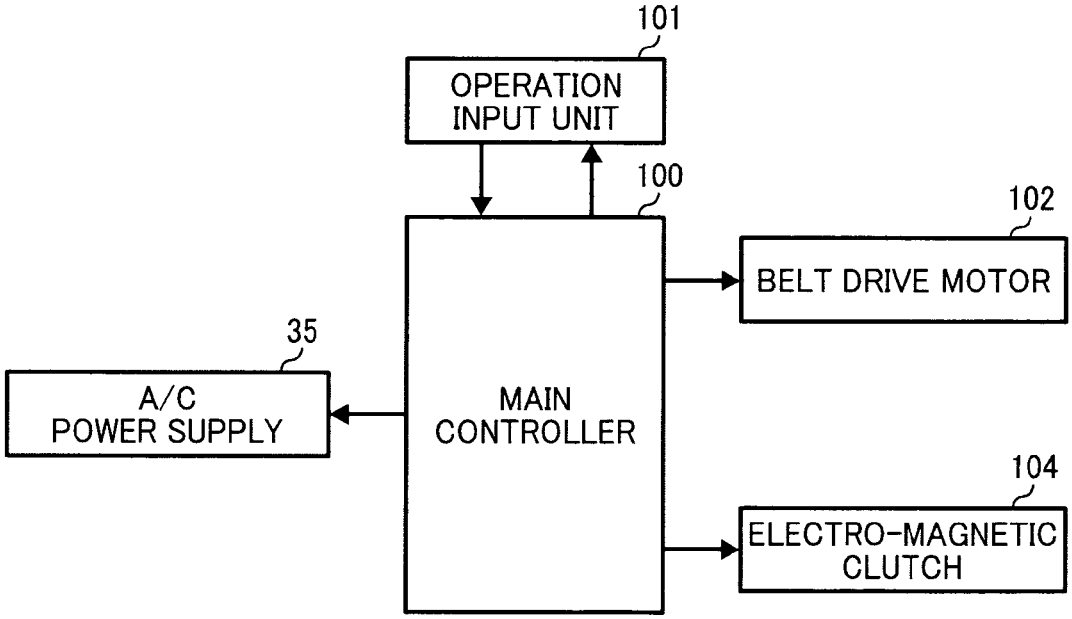
FIG. 2 is a block diagram illustrating a configuration of a control unit of the image forming apparatus shown in FIG. 1.

FIG. 2 is a block diagram illustrating a configuration of a control unit 100 provided to the image forming apparatus 10 according to an exemplary embodiment of the present patent application.

As illustrated in FIG. 2, the control unit 100 is a microcomputer that includes a central processing unit (CPU), a read-only memory (ROM), a random access memory (RAM), an input and output (I/O) interface, and the like.

The control unit 100 shown in FIG. 2 is connected to an operation input unit 101, a belt drive motor 102, an electromagnetic clutch 104, an alternating current (A/C) power supply 35, and other unillustrated various sensors and motors provided to the image forming apparatus 10.

The control unit 100 controls operations of the belt drive motor 102 and the electro-magnetic clutch 104 according to signals inputted from the operation input unit 101, and so forth.

The operation input unit 101 is provided in the image forming apparatus 10 and includes various keypads such as a numeric keypad and a print start keypad, and various indicators. A user inputs sheet information such as material and size of a sheet directly or selects the sheet information via selection buttons through the operation input unit 101 when feeding the sheet by a sheet cassette 15, which will be described below. The sheet information inputted or selected by the user is converted to a signal and is outputted to the control unit 100.

The belt drive motor 102 rotates a drive roller 31 included in the sheet supplying device 13 according to the input signal from the control unit 100. The details of the drive roller 31 will be described below.

The electro-magnetic clutch 104 is disposed between the belt drive motor 102 and the drive roller 31 and switches between opening (transmitting) and closing (blocking) the power source between the belt drive motor 102 and the drive roller 31 according to the input signal from the control unit 100.

The A/C power supply 35 supplies a charging voltage to a charging roller, described below, according to the input signal from the control unit 100.

Figure 3:
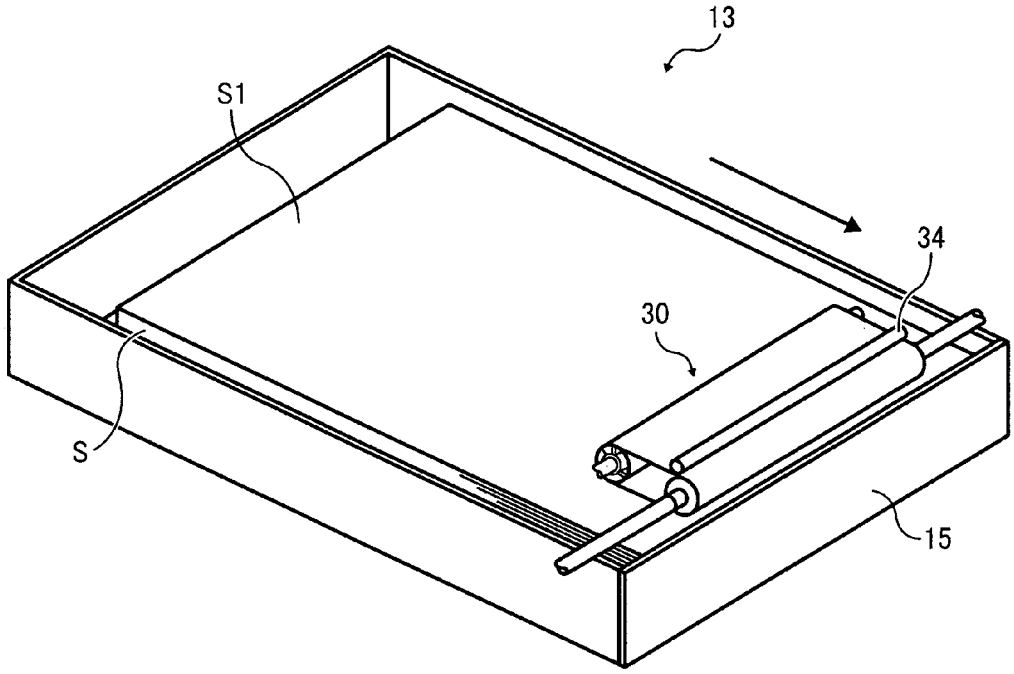
FIG. 3 is a perspective view of the sheet feeding device incorporated in the image forming apparatus shown in FIG. 1, according to the present patent application.

FIG. 3 is a perspective view of the sheet supplying device 13 incorporated in the image forming apparatus 10.

As illustrated in FIG. 3, the sheet supplying device 13 includes the sheet cassette 15 and a sheet feeder 30. The sheet cassette 15 serves as a sheet container and loads the sheet stack S therein to attract the uppermost sheet S1 placed on top of the sheet stack S to the sheet feeder 30 and pick up and feed the uppermost sheet S1 from the sheet stack S.

The uppermost sheet S1 picked up by the sheet feeder 30 travels in a sheet conveyance path 17 that passes through the nip formed between the pair of conveyance rollers 18 and the secondary transfer nip formed between the transfer roller 19 and a roller facing the transfer roller 19 with the intermediate transfer belt 24 interposed therebetween.

As illustrated in FIG. 3, the sheet feeder 30 is disposed above the sheet cassette 15 and employs an electrostatic sheet feed method in which the uppermost sheet S1 is picked up from the sheet stack S by being attracted by a charged dielectric belt 33, which will be described below. A width along an axial direction of the sheet feeder 30 is narrower or smaller than that of any sheet that can be loaded in the sheet cassette 15 and is disposed in the vicinity of the latitudinal center in the width direction of the loadable sheet. Alternatively, the width of the sheet feeder 30 can be equal to or greater than that of any loadable sheet. Further, two or more sheet separation feeders 30 can be disposed along the width of any loadable sheet while one sheet feeder 30 is provided in the vicinity of the latitudinal center in the width of the uppermost sheet S1 in the sheet supplying device 13 in FIG. 3.

Figure 4:
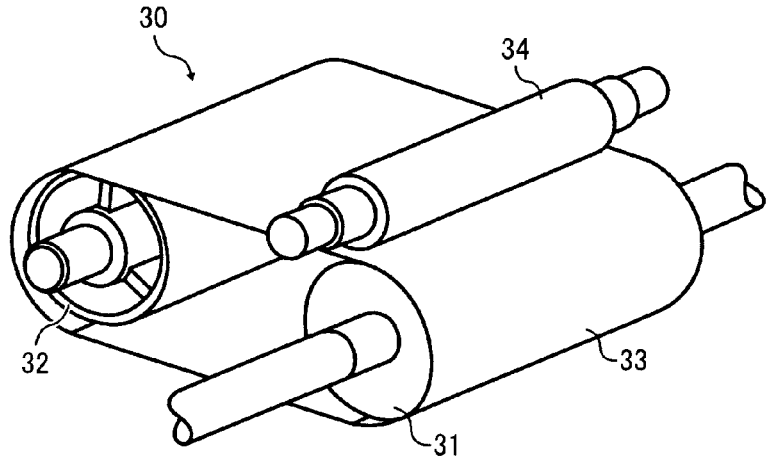
FIG. 4 is a perspective view of a sheet separation feeder according to the preset patent application.

FIG. 4 is a perspective view of the sheet feeder 30 incorporated in the image forming apparatus 10.

As illustrated in FIG. 4, the sheet feeder 30 includes the drive roller 31, the driven roller 32, the dielectric belt 33, and a charging roller 34. The charging roller 34 is an electrode extending along the width of the dielectric belt 33. The charging roller 34 contacts the surface of the dielectric belt 33 to serve as an electric potential pattern forming unit to form predetermined electric potential pattern on the surface of the dielectric belt 33.

Figure 5:
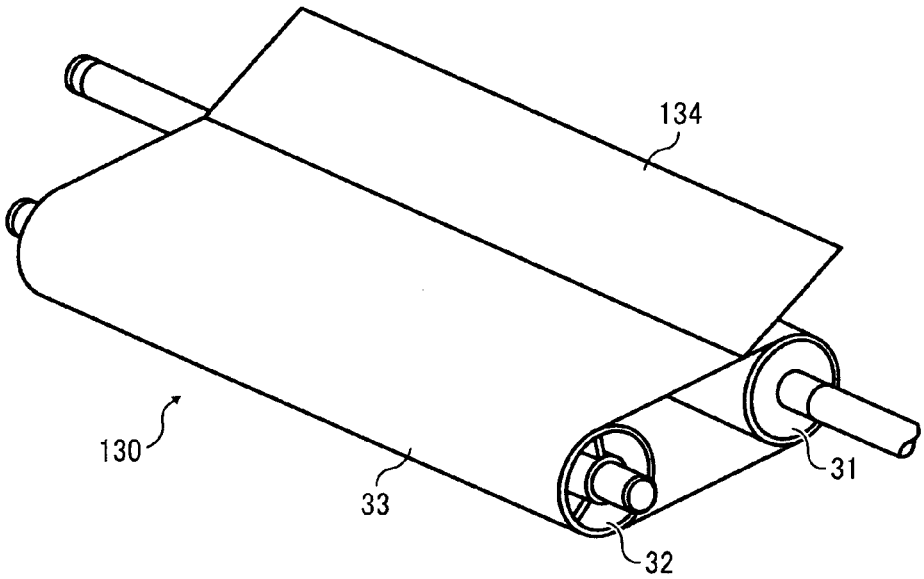
FIG. 5 is a side view of a modification of the sheet separation feeder shown in FIG. 4, according to the present patent application.

In this exemplary embodiment, the charging roller 34 is employed as an electric potential pattern forming unit. However, as shown in FIG. 5, a modified sheet feeder 130 can employ a blade-type charging member 134 as the electric potential pattern forming unit.

Figure 6:
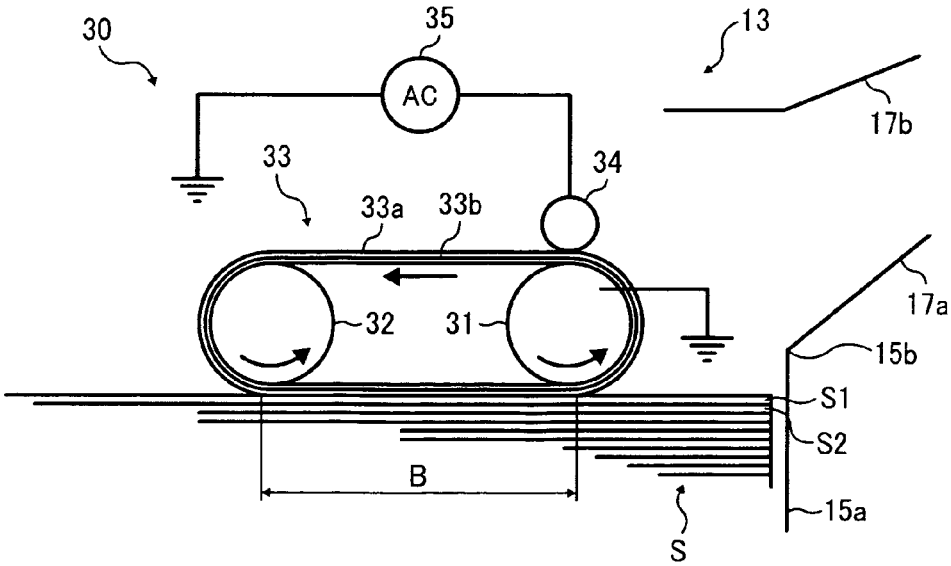
FIG. 6 is a side view of the sheet feeding device shown in FIG. 1, according to the present patent application.

FIG. 6 illustrates a schematic configuration of the sheet feeder 30 and other units in the sheet supplying device 13.

As illustrated in FIG. 6, the dielectric belt 33 according to this exemplary embodiment is looped over the drive roller 31 and the driven roller 32. The dielectric belt 33 has a multilayer construction that includes a front layer 33*a* having a resistivity of about $10^8$ Ω·cm or greater (for example, a polyethylene terephthalate film having a thickness of about 100 μm) and a back layer 33*b* having a resistivity of about $10^6$ Ω·cm or smaller to maintain a good charging state.

The dielectric belt 33 is not limited to have the double-layer structure but can have a single-layer structure or a structure having three or more layers. The charging roller 34 can be disposed at any position on the front layer 33*a*. Further, the dielectric belt 33 can be disposed any position facing the sheet stack S and possible to obtain a sufficient area on the surface for attracting the sheet stack S.

An outer surface of the drive roller 31 includes a conductive rubber layer having a resistivity of about $10^6$ Ω·cm. An inner part of the conductive rubber layer of the drive roller 31 includes a rubber material having a resistivity of about $10^6$ Ω·cm. Both the surface and the inner part of the driven roller 31 include metal. The driven roller 32 rotates with rotation of the dielectric belt 33 that is driven by the drive roller 31. It is to be noted that the drive roller 31 and the driven roller 32 are electrically grounded. The drive roller 31 has a small diameter suitable to remove the uppermost sheet S1 from the dielectric belt 33 by a curvature of the drive roller 33. For example, the great curvature caused by the small diameter of the drive roller 31 separates the uppermost sheet S1 attracted by the dielectric belt 33 from the surface of the dielectric belt 33 looped over the drive roller 31, and the dielectric belt 33 driven by the drive roller 31 feeds the removed uppermost sheet S1 toward the sheet conveyance path 17 that is defined by an upper guide plate 17*b* and a lower guide plate 17*a* provided downstream from the drive roller 31 in the sheet feeding direction.

The charging roller 34 is disposed to contact the outer surface of the dielectric belt 33 in the vicinity of which the dielectric belt 33 is looped over the drive roller 31. The charging roller 34 is connected to the A/C power supply 35 that generates alternating current. The charging roller 34 and the A/C power supply 35 together serve as a potential patter forming unit. An electric discharging unit to electrically discharge the charges on the surface of the dielectric belt 33 can be disposed upstream from the charging roller 34 in the belt moving direction in which the lower surface of the dielectric belt 33 facing the uppermost sheet S1 moves and downstream from the sheet separation position where the uppermost sheet S1 separates from the dielectric belt 33.

The sheet feeder 30 according to this exemplary embodiment includes a contact and separation unit to contact the dielectric belt 33 to the surface of the sheet stack S and separate the dielectric belt 33 from the sheet stack S. The contact and separation unit causes the dielectric belt 33 looped over the drive roller 31 and the driven roller 32 to move reciprocally up and down in a vertical direction with respect to the sheet stack S. With this action, a lower flat portion B of the dielectric belt 33, which is tensioned by the drive roller 31 and the driven roller 32 and faces the sheet stack S, contacts and separates the upper surface of the sheet stack S while remaining parallel to the surface of the sheet stack S.

The sheet cassette 15 that accommodates the sheet stack S includes a side wall 15*a* at the leading area of a sheet in a sheet feeding direction to regulate the leading edge of the sheet stack S. The upper end of the side wall 15*a* is connected to the upstream end of the lower guide plate 17*a* that regulates the uppermost sheet S1 fed by the sheet feeder 30 from the lower side of the sheet conveyance path. The upper end of the side wall 15*a* is set higher than the upper surface of the sheet stack S.

Next, a description is given of the sheet feeding operation to feed the uppermost sheet S1, according to the present patent application.

The control unit 100 transmits a sheet feeding signal to turn on the electro-magnetic clutch 104 and start to drive the belt drive motor 102. According to the start of the belt drive motor 102, the drive roller 31 in the sheet cassette 15 rotates. Accordingly, the endless belt 33 starts rotating between the drive roller 31 and the driven roller 32.

Then, the charging roller 34 that is connected to the A/C power supply 35 applies an alternating voltage to the dielectric belt 33 in rotation. Consequently, the electric potential patterns or the charge patterns of positive potential holding section and negative potential holding section are formed on the surface of the dielectric belt 33, at pitches or intervals determined by the frequency of the A/C power supply 35 and the rotation speed (e.g., the circumferential speed) of the dielectric belt 33. The electric potential patterns or the charge patterns are alternately provided on the front layer 33*a* of the dielectric belt 33 in a direction in which the lower flat portion B of the dielectric belt 33 moves. Namely, the dielectric belt 33 is charged with the alternating voltage.

When the electric potential pattern is formed at least on the lower flat portion B of the dielectric belt 33 that attracts the uppermost sheet S1 of the sheet stack S, the control unit 100 turns off the electro-magnetic clutch 104 so that the drive roller 31 stops rotating. The control unit 100 then causes the contact and separation unit to lower the dielectric belt 33 that is not in rotation to cause the dielectric belt 33 to contact the surface of the sheet stack S. After a predetermined period of time has elapsed, the control unit 100 causes the contact and separation unit to raise the dielectric belt 33. At this time, the uppermost sheet S1 remains in electrically contact with the lower flat portion B of the dielectric belt 33, and therefore, the dielectric belt 33 separates from the sheet stack S as it moves up. Then, the control unit 100 turns on the electro-magnetic clutch 104 again so that the drive roller 31 starts rotating. As the dielectric belt 33 rotates, the uppermost sheet S1 is conveyed forward through the sheet conveyance path 17 defined by the lower guide plate 17*a* and the upper guide plate 17*b* to regulate the sheet feeding direction, toward the pair of conveyance rollers 18.

Figure 7:
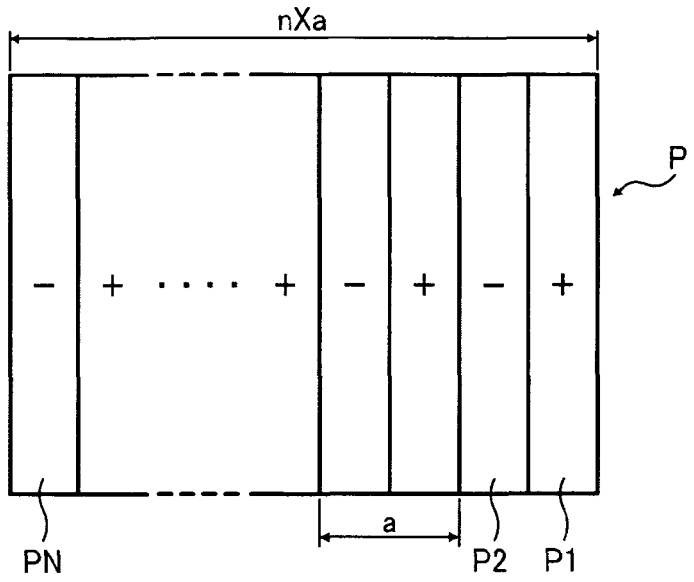
FIG. 7 is a drawing of an example of electric potential pattern formed on a surface of a belt that attracts an uppermost sheet of a sheet stack.

FIG. 7 illustrates an electric potential pattern P having multiple potential holding sections formed on the lower flat portion B of the dielectric belt 33 for attracting the uppermost sheet S1 of the sheet stack S.

As illustrated in FIG. 7, the electric potential pattern P formed on the lower flat portion B of the dielectric belt 33 includes multiple potential holding sections P1, P2, . . . , and PN. The multiple potential holding sections P1 through PN are disposed at equal intervals. Each of the adjacent potential holding sections has an absolute value identical to every other and an opposite polarity from the adjacent potential holding sections. Specifically, each of the potential holding sections P1 through PN of the electric potential pattern P is a band-like shape extending in a width direction of the dielectric belt 33 and the potential holding sections of opposite polarities are arranged alternately in the sheet feed direction. In this exemplary embodiment, a pitch "a" of a pair of adjacent potential holding sections of opposite polarities is determined by the frequency of the A/C power supply 35 and the rotation speed of the dielectric belt 33. The pitch "a" is preferably in a range of from 2 mm to 15 mm, and more preferably from 2 mm to 4 mm.

The voltage to be applied to the charging roller 34 can be any alternating voltage such as a voltage formed by sine waves. Further, instead of the alternating current, the A/C power supply 35 may apply a direct current in which high and low potentials are alternately provided. According to this particular example embodiment, the A/C power supply 35 applies an alternating current having amplitude of about 4 KV to the surface of the dielectric belt 33.

In this exemplary embodiment, when the lower flat portion B of the dielectric belt 33 having the electric potential pattern thereon contacts the upper surface of the sheet stack S, a non-uniform electric field formed by the electric potential pattern on the surface of the dielectric belt 33 generates Maxwell stress. Accordingly, the uppermost sheet S1 is attracted to and held on the lower flat portion B of the dielectric belt 33.

The force of attraction generated by the electric potential pattern to the dielectric belt 33 is exerted on the uppermost sheet S1, the second uppermost sheet S2, and, in some cases, any subsequent sheets for a predetermined period of time from the moment the dielectric belt 33 contacts the sheet stack S before being picked up from the sheet stack S. However, after the predetermined period of time has elapsed, this force of attraction acts on the uppermost sheet S1 only. Namely, the force of attraction does not act on the second uppermost sheet S2 and other subsequent sheets. Therefore, by waiting for the predetermined period of time since the uppermost sheet S1 is attracted to the dielectric belt 33 to elapse, only the uppermost sheet S is picked up and removed from other sheets in the sheet stack S and fed in the sheet feeding direction. In other words, even when the sheet feeder 30 does not include any additional sheet separation mechanism, the uppermost sheet S1 can be picked up from the sheet stack S stably and reliably.

The inventors of the present patent application have found that, when the dielectric belt 33 contacts the uppermost sheet S1, the uppermost sheet S1 is charged to either polarity by the charges of the electric potential pattern P formed on the surface (i.e., the lower flat portion B) of the dielectric belt 33, and the uppermost sheet S1 and other subsequent sheets including the second uppermost sheet S2 are electrostatically attracted to each other.

More particularly, when the sum total (positive number) of charges of the electric potential pattern P formed on the surface of the dielectric belt 33 is completely far from zero, the uppermost sheet S1 gets charged to the positive polarity as the surface of the dielectric belt 33 having such electric potential pattern P contacts the uppermost sheet S1.

If the surface of the dielectric belt 33 having the above-described electric potential pattern P contacts the uppermost sheet S1, the uppermost sheet S1 is charged to alternating potential portions that form the positive and negative potential holding sections when it contacts the surface of the dielectric belt 33. Each distance between adjacent alternating potential holding sections is set to a given distance of 2 mm to 15 mm, for example, that is close enough to form a non-uniform electric field that exerts a force of attraction based on the Maxwell stress to convey the uppermost sheet as the dielectric belt 33 rotates while attracting the uppermost sheet S1. Therefore, the charges on the alternating potential holding sections on the surface of the uppermost sheet S1 are neutralized with the adjacent potential holding sections charged to opposite polarity to be dissolved. Even if the charges remain in the uppermost sheet S1, from a view point of the second uppermost sheet S2, the charge on the surface thereof can be compensated to zero according to the relation of the adjacent potential holding sections of opposite polarity with an identical amount. Therefore, as described above, if the sum total of charges of electric potential pattern P on the dielectric belt 33, the uppermost sheet S1 is charged due to the charge that cannot be neutralized or compensated with the adjacent charge of opposite polarity. When the uppermost sheet is charged to the positive polarity, an electrostatic force is exerted to attract the second uppermost sheet to the lower surface of the uppermost sheet. As a result, the uppermost sheet S1 attracts the second uppermost sheet S2 electrostatically.

In this present invention, the sum total of charges of electric potential pattern P formed on the surface of the dielectric belt 33 that attracts the uppermost sheet S1 is substantially zero. Consequently, due to the charge of electric potential pattern P on the dielectric belt 33, the sum total of charges on the uppermost sheet S1 also is zero. As a result, the uppermost sheet S1 is prevented from charging, thereby reducing the electrostatic attraction between the uppermost sheet S1 and the second uppermost sheet S2.

In this exemplary embodiment, a relation of the length of the lower flat portion B of the dielectric belt 33 that attracts to the uppermost sheet S1 of the sheet stack S and the pitch "a" of the electric potential pattern P formed on the lower flat portion B of the dielectric belt 33 is set as follows.

As shown in FIG. 7, the integral multiple of the pitch "a" of the electric potential pattern is set to be equal to the length of the lower flat portion B in the sheet feeding direction. Namely, the following equation is satisfied.

The length of the lower flat portion B=n×a, where "n" represents a natural number, satisfying the relation of "n=N/2". Accordingly, in theory the sum total of charges of the electric potential pattern P formed on the lower flat portion B of the dielectric belt 33 for attracting the uppermost sheet S1 of the sheet stack S becomes substantially zero. Accordingly, this can prevent a fact that the uppermost sheet S1 contacting the lower flat portion B of the dielectric belt 33 is charged to either polarity and can prevent the uppermost sheet S1 and any subsequent sheets of the sheet stack S from being charged. As a result, the electrostatic attraction between adjacent charged sheets can be prevented, thereby stably conveying the uppermost sheet S1.

As described above, the image forming apparatus 10 forms an image on the uppermost sheet S1 serving as a recording medium that is fed by the sheet feeder 30 serving as a sheet feeding unit. The sheet feeder 30 is disposed facing the upper surface of the sheet stack S and includes the dielectric belt 33 that rotates endlessly, and the charging roller 34 and the A/C power supply 35. The charging roller 34 and the A/C power supply 35 serve as an electric potential pattern forming unit to form the electric potential pattern P including the multiple potential holding sections P1 through PN on the surface of the dielectric belt 33. The multiple potential holding sections P1 through PN of the electric potential pattern P are arranged such that potential holding sections having opposite polarities are disposed adjacently. By the action of the electric field generated by the electric potential pattern P, the uppermost sheet S1 of the sheet stack S is attracted to the surface of the dielectric belt 33. As the dielectric belt 33 rotates, the uppermost sheet S1 is advanced forward. In this exemplary embodiment, the electric potential pattern P is formed such that the sum total of charges of the electric potential pattern P formed on the lower flat portion B of the dielectric belt 33 for attracting the uppermost sheet S1 of the sheet stack S becomes substantially zero.

More specifically, the electric potential pattern P includes multiple potential holding sections P1 through PN that are disposed at equal intervals, each having an absolute value identical to every other and a different polarity from the adjacent potential holding sections. The electric potential pattern P is formed on the surface of the dielectric belt 33 such that the number of positive potential holding sections and the number of negative potential holding sections formed on the lower flat portion B of the dielectric belt 33 are equal to each other, i.e., that the number of positive potential holding sections and the number of negative potential holding sections are equal to each other.

Accordingly, the uppermost sheet S1 that contacts the surface of the dielectric belt 33 can be charged not to either one polarity or the other but to both polarities alternately, which can prevent the uppermost sheet S1, the second uppermost sheet S2 and/or any other subsequent sheets from being charged. As a result, electrostatic attraction between sheets caused by the charged sheets can be prevented, thereby stably separating and conveying only the uppermost sheet S1.

This exemplary embodiment may not hinder to provide another sheet feeding unit to avoid a more stable sheet picking up operation.

Further, in this exemplary embodiment, the electric potential pattern P includes the potential holding sections P1 through PN, each having a band-like shape extending in a widthwise direction of a sheet, that is, a direction perpendicular to the sheet feeding direction, and the potential holding sections, each of which is charged to either positive polarity or negative polarity, are arranged alternatively in the sheet feeding direction. Compared to an electric potential pattern in which positive and negative potential holding sections are arranged alternately across a two-dimensional direction, like a grid-like electric potential pattern, the electric potential pattern P can be formed on the surface of the dielectric belt 33 with a simpler structure, thereby reducing costs. Nevertheless, as another structure according to an exemplary embodiment, a grid-like electric potential pattern can be formed.

In this exemplary embodiment, the sheet feeder 30 includes the dielectric belt 33 the surface that is charged from outside, but is not limited thereto. For example, instead of the dielectric belt 33, the sheet feeder 30 can employ a dielectric belt 233 that has a structure as shown in FIG. 8.

Figure 8:
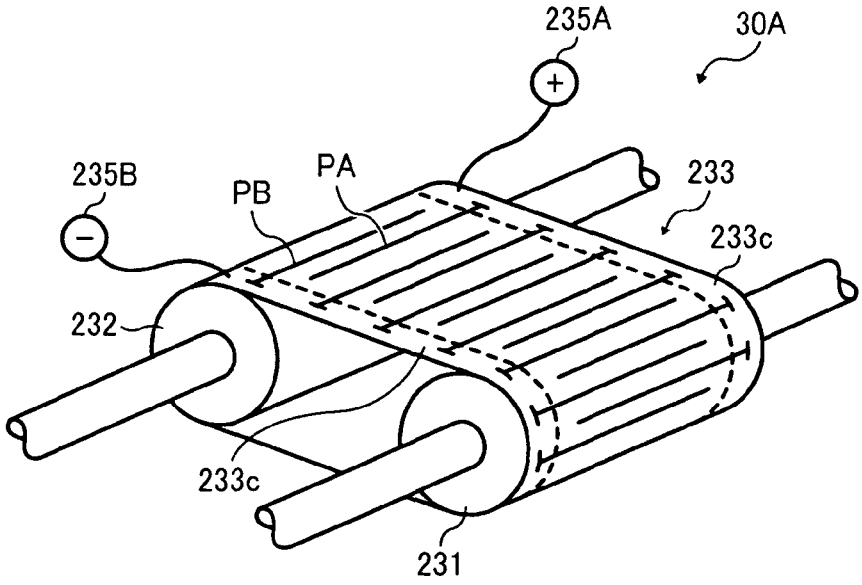
FIG. 8 is a perspective view of another example of electric potential pattern formed by an electric potential pattern forming unit according to the present patent application.

FIG. 8 is a perspective view of a sheet feeder 30A according to another exemplary embodiment. As illustrated in FIG. 8, the sheet feeder 30A includes a dielectric belt 233 that is looped around a drive roller 231 and a driven roller 232. The dielectric belt 233 has a surface on or inside which a comb-shaped positive potential holding section PA and a comb-shaped negative potential holding section PB are arranged alternately in the sheet feeding direction on the surface of the dielectric belt 233. An alternating current (A/C) power supply 235A applies a positive voltage to the positive potential holding section PA and an alternating current (A/C) power supply 235B applies a negative voltage to the negative potential holding section PB. Power receiving portions 233*c* are exposed on edges in the width direction of the dielectric belt 233 on the surface of the dielectric belt 233 to receive the voltage applied from the A/C power supplies 235A and 235B through the power receiving portions 233*c* to the positive potential holding section PA and the negative potential holding section PB. As long as the number of positive potential holding sections PA and the number of negative potential holding sections P formed on the surface of the dielectric belt 233 contacting the uppermost sheet S1 of the sheet stack are equal, this structure of the dielectric belt 233 of the sheet feeder 30A can achieve the same effect as the structure of the dielectric belt 33 of the sheet feeder 30.

Further, in this exemplary embodiment, the electric potential pattern P is formed to a length that is of integral multiple of the pitch of adjacent potential holding sections of different properties and equal to an entire length of any sheet of the sheet stack S in the sheet feeding direction. Accordingly, the sheets can be separated and conveyed more stably.

Figure 9:
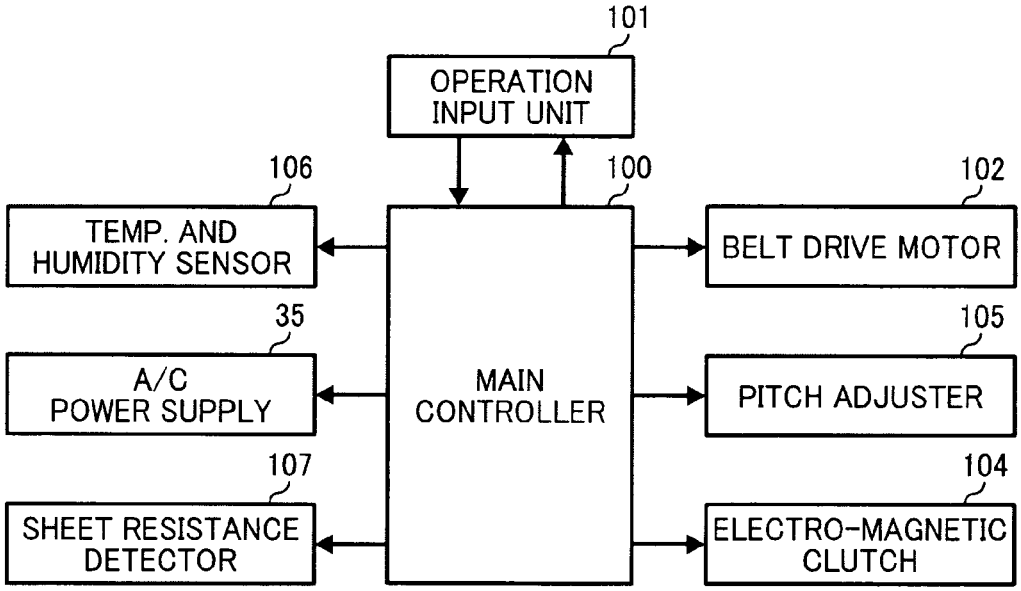
FIG. 9 is a block diagram illustrating a configuration of a modification of the control unit provided to the image forming apparatus shown in FIG. 1.

FIG. 9 is a block diagram illustrating a configuration of a modification of the control unit 100 provided to the image forming apparatus 10.

As illustrated in FIG. 9, the control unit 100 can further include a pitch adjuster 105, a temperature and humidity sensor 106, and a sheet resistance detector 107. Elements or components of the control unit 100 of FIG. 9 may be denoted by the same reference numerals as those of the control unit 100 of FIG. 2 and the descriptions thereof are omitted or summarized.

The control unit 100 can cause the pitch adjuster 105 to change the pitch "a" of positive potential holding sections and negative potential holding sections formed on the electric potential pattern P. The pitch adjuster 105 does this by changing the frequency of the A/C power supply 35 and the rotation speed of the dielectric belt 33.

If the ambient conditions such as temperature and humidity vary, the electrical characteristics of the dielectric belt 33 and/or the amount of moisture in the sheet can vary as well, thereby changing the force of attraction of the sheet with respect to the surface of the dielectric belt 33. Generally, as the temperature and humidity decline, the amount of the force of attraction of the uppermost sheet S1 with respect to the dielectric belt 33 decreases. Therefore, the control unit 100 can cause the temperature and humidity sensor 106 that serves as an ambient detector to detect the ambient condition and cause the pitch adjuster 105 to adjust the pitch according to detection results obtained by the temperature and humidity sensor 106, i.e., the pitch "a" of the electric potential pattern P under the ambient condition of low temperature and low humidity is smaller than the pitch "a" of the electric potential pattern P under the ambient condition of high temperature and high humidity. The smaller the pitch "a" of the electric potential pattern P becomes, the more the force of attraction of a sheet with respect to the dielectric belt 33 increases. Therefore, even under the ambient condition of low temperature and low humidity, a sufficient force of attraction of a sheet with respect to the dielectric belt 33 can be obtained, thereby stably separating and feeding the sheet even under the low-temperature and low-humidity condition.

Further, if the sheet resistance is changed due to changes of types of sheets accommodated in the sheet cassette 15 and changes of environment, the amount of force of attraction with respect to the surface of the dielectric belt 33 can change. Generally, as the electrical resistance of sheet increases, the force of attraction of a sheet with the dielectric belt 33 decreases. Therefore, the control unit 100 can cause the sheet resistance detector 107 to detect the electrical resistance of a sheet, and cause the pitch adjuster 105 to adjust the pitch according to the detection results obtained by the sheet resistance detector 107, i.e., when the resistance of a sheet is greater, the pitch "a" of the electric potential pattern P is adjusted to be smaller. With this adjustment, even if the resistance of a sheet is high, a sufficient force of attraction can be obtained, thereby stably separating and feeding the sheet.

If the pitch adjuster 105 changes the pitch "a" of the electric potential pattern P to a pitch corresponding to one pitch option that can be selected from among predetermined multiple pitch options, it is preferable that a length of the dielectric belt 33 having the surface contacting the uppermost sheet S1 of the sheet stack S in the sheet feeding direction is matched to a length of the least common multiple of each pitch according to the predetermined multiple pitch options. In this case, in theory, for any given pitch option is selected, the sum total of electric charges of the electric potential pattern P formed on the surface of the dielectric belt 33 that attracts to the uppermost sheet S1 of the sheet stack S can be set to zero in theory design.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that the invention may be practiced otherwise than as specifically described herein.

What is claimed is:

1. An image forming apparatus, comprising:

an image forming device to form an image on a surface of a sheet; and a sheet feeding unit to feed the sheet to the image forming device, the sheet feeding unit including:

an endless, dielectric belt disposed facing an upper surface of a sheet stack including an uppermost sheet of multiple sheets to contact and attract the uppermost sheet to a surface thereof and feed in a sheet feeding direction as the dielectric belt rotates; and an electric potential pattern forming unit to form an electric potential pattern having multiple potential holding sections disposed at a uniform pitch on the surface of the dielectric belt, the multiple potential holding sections disposed adjacent to each other having opposite polarities of positive potential holding sections and negative potential holding sections along the sheet feeding direction, and having identical absolute values of the positive potential holding sections and the negative potential holding sections, wherein a sum of areas of the positive potential holding sections and a sum of areas of the negative potential holding sections in a range where the belt faces the uppermost sheet respectively are unchanging or remain constant even when the belt rotates, so as to retain a length of the potential holding sections in the sheet feeding or conveyance direction, and wherein the range corresponds to an entire flat portion of a lower flat portion of the belt disposed facing the uppermost sheet.

2. The image forming apparatus according to claim 1, wherein the multiple potential holding sections of the electric potential pattern each have a band-like shape extending in a direction perpendicular to the sheet feeding direction, with potential holding sections of opposite polarities arranged alternately in the sheet feeding direction.

3. The image forming apparatus according to claim 2, wherein the electric potential pattern forming unit forms the electric potential pattern to a length that is an integral multiple of the pitch of adjacent potential holding sections of different properties and equal to the length of a sheet of the sheet stack.

4. The image forming apparatus according to claim 1, further comprising a pitch adjuster to change the pitch between adjacent potential holding sections of different properties formed by the electric potential pattern forming unit.

5. The image forming apparatus according to claim 4, wherein the pitch adjuster changes the pitch between the adjacent potential holding sections of different properties according to one pitch option selected from among multiple pitch options, wherein the length of the potential holding sections in the sheet feeding or conveyance direction is a length that is an integral multiple of the least common multiple of each pitch according to the multiple pitch options.

6. The image forming apparatus according to claim 4, further comprising a sheet resistance detector to detect an electrical resistance of a sheet of the sheet stack, the pitch adjuster changing the pitch based on detection results obtained by the sheet resistance detector.

7. The image forming apparatus according to claim 4, further comprising an ambient condition detector to detect at least one of temperature and humidity in the image forming apparatus, the pitch adjuster changing the pitch based on detection results obtained by the ambient condition detector.

8. The image forming apparatus according to claim 1, wherein the dielectric belt is looped over a drive roller and a driven roller.

9. The image forming apparatus according to claim 8, wherein the drive roller and the driven roller have non-eccentric axes and form the lower flat portion therebetween.

10. A sheet feeding unit, comprising:

an endless, dielectric belt disposed facing an upper surface of a sheet stack including an uppermost sheet of multiple sheets to contact and attract the uppermost sheet to a surface thereof and feed in a sheet feeding direction as the dielectric belt rotates; and an electric potential pattern forming unit to form an electric potential pattern having multiple potential holding sections disposed at a uniform pitch on the surface of the dielectric belt, the multiple potential holding sections disposed adjacent to each other having opposite polarities of positive potential holding sections and negative potential holding sections along the sheet feeding direction, and having identical absolute values of the positive potential holding sections and the negative potential holding sections, wherein a sum of areas of the positive potential holding sections and a sum of areas of the negative potential holding sections in a range where the belt faces the uppermost sheet respectively are unchanging or remain constant even when the belt rotates, so as to retain a length of the potential holding sections in the sheet feeding or conveyance direction, and wherein the range corresponds to an entire flat portion of a lower flat portion of the belt disposed facing the uppermost sheet.

11. The sheet feeding unit according to claim 10, wherein the multiple potential holding sections of the electric potential pattern each have a band-like shape extending in a direction perpendicular to the sheet feeding direction, with potential holding sections of opposite polarities arranged alternately in the sheet feeding direction.

12. The sheet feeding unit according to claim 11, wherein the electric potential pattern forming unit forms the electric potential pattern to a length that is an integral multiple of the pitch of adjacent potential holding sections of different properties and equal to the length of a sheet of the sheet stack.

13. The sheet feeding unit according to claim 10, further comprising a pitch adjuster to change the pitch between adjacent potential holding sections of different properties formed by the electric potential pattern forming unit.

14. The sheet feeding unit according to claim 13, wherein the pitch adjuster changes the pitch between the adjacent potential holding sections of different properties according to one pitch option selected from among multiple pitch options, wherein the length of the potential holding sections in the sheet feeding or conveyance direction is a length that is an integral multiple of the least common multiple of each pitch according to the multiple pitch options.

15. The sheet feeding unit according to claim 13, further comprising a sheet resistance detector to detect an electrical resistance of a sheet of the sheet stack, the pitch adjuster changing the pitch based on detection results obtained by the sheet resistance detector.

16. The sheet feeding unit according to claim 13, further comprising an ambient condition detector to detect at least one of temperature and humidity in the image forming apparatus, the pitch adjuster changing the pitch based on detection results obtained by the ambient condition detector.

17. The sheet feeding unit according to claim 10, wherein the dielectric belt is looped over a drive roller and a driven roller.

18. The sheet feeding unit according to claim 17, wherein the drive roller and the driven roller have non-eccentric axes and form the lower flat portion therebetween.

* * * * *